United States Patent [19]

Breckwoldt

[11] Patent Number: 4,807,648

[45] Date of Patent: Feb. 28, 1989

[54] NON-BURNING TOBACCO SUBSTITUTE

[75] Inventor: Robert G. Breckwoldt, Goshen, N.Y.

[73] Assignee: Tripar Incorporated, Stamford, Conn.

[21] Appl. No.: 135,326

[22] Filed: Dec. 21, 1987

[51] Int. Cl.[4] ..... A24D 1/18

[52] U.S. Cl. ..... 131/359; 131/369

[58] Field of Search ..... 131/359, 369, 275, 276, 131/335

*Primary Examiner*—V. Millin

*Assistant Examiner*—J. Cheng

*Attorney, Agent, or Firm*—Kane, Dalsimer, Sullivan, Kurucz, Levy, Eisele and Richard

[57] ABSTRACT

A non-smoking material comprises a non-cellulose carrier homogenously mixed with a flavor enhancing proportion of distiller's dried grain with solubles. The non-burning composition is useful as a tobacco substitute. In one use, the composition of the invention is disposed in a cigarette like form to simulate a cigarette and used in a similar manner to give the "smoker" pleasure and oral gratification.

6 Claims, 1 Drawing Sheet

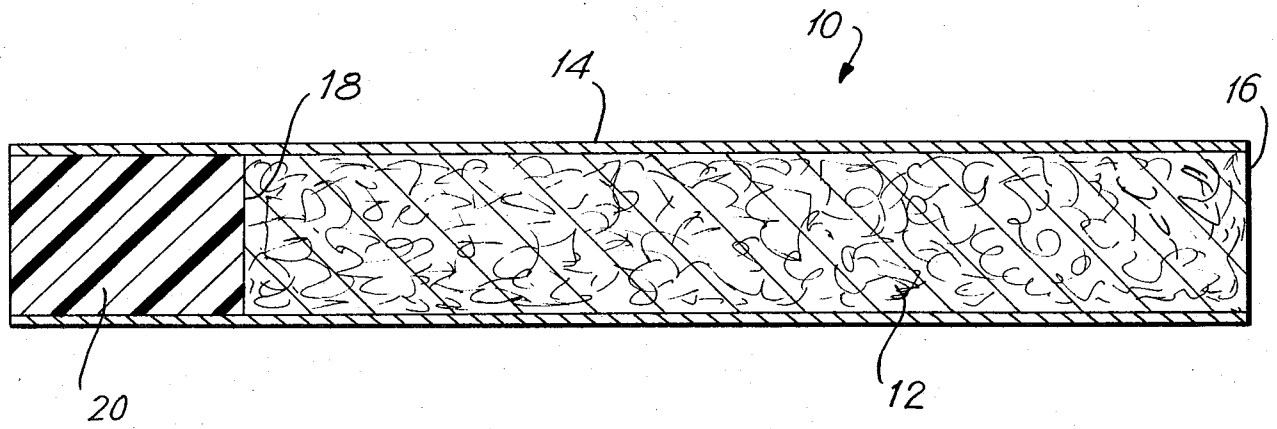
10
14
18
20
16
12

NON-BURNING TOBACCO SUBSTITUTEcl

BACKGROUND OF THE INVENTION

1. Field of the Invention

The invention relates to a composition of natural material, useful as a non-burning substitute for tobacco.

2. Brief Description of the Prior Art

In recent years there has been concern about the biological effect of tobacco smoke upon the smoker and humans exposed to the smoke (passive smokers). Many of the compounds identified in tobacco smoke are associated with health hazards, including lung carcinoma. A table listing some of the health harming constituents of tobacco smoke may be found in the publication *Tobacco and Tobacco Smoke, Studies in Experimental Carcinogens,* by Ernest L. Wynder et al, Sloan-Kettering Institute for Cancer Research, pgs. 496–501 (1967).

To obviate this health concern, attention has focused on non-combustible (non-burning), tobacco substitutes which can satisfy a smoker's need for oral gratification, physiological satisfaction and pleasure. Such compositions have an additional advantage in that their use obviates the danger of igniting an accidental fire, often associated with lit smoking articles.

The present invention is of a composition which is useful as a non-burning tobacco substitute, and which may be used in the same manner as a smoking article such as a cigarette. However, combustion of the material is not required for "smoking" pleasure. In one embodiment of the invention, nicotine may be present in the compositions of the invention to satisfy a user's physiological need for that ingredient.

SUMMARY OF THE INVENTION

The invention comprises a non-burning tobacco substitute, which comprises; a non-cellulose organic or inorganic carrier and a flavor enhancing proportion of distiller's dried grain and solubles; said composition being free of tobacco. The invention also comprises articles made from the compositions of the invention.

The compositions and the articles of the invention are useful as non-burning substitutes for tobacco smoking compositions and articles.

BRIEF DESCRIPTION OF THE DRAWING

The accompanying drawing is a cross-sectional side elevation of an embodiment article of the invention.

DETAILED DESCRIPTION OF THE PREFERRED EMBODIMENTS OF THE INVENTION

Distiller's dried grain with solubles (referred to hereinafter at times as "DDGS") is the product obtained upon drying stillage (sometimes called "slop"), which is the residue after distillation and removal of alcohols from beer or fermentated grain mash. Typically the DDGS is prepared by first separating fiber or suspended solids from the stillage. The residue of soluble solids is then concentrated to the consistency of a paste (called syrup) and then remixed with the separated fiber. The remixed fiber and syrup is then dried to obtain a meal which is the DDGS employed in the present invention.

The DDGS is readily available from commercial sources. The composition of DDGS is well known. A typical DDGS composition will comprise crude protein (27 percent by weight), crude fat (8 percent by weight) and crude fiber (8.5 percent by weight); dry matter constituting about 92.5 percent by weight.

In the present invention, DDGS functions to provide a volatile (at room temperature) flavoring for a non-cellulose composition useful as the non-burning tobacco substitute.

The compositions of the invention are prepared by homogeneously mixing the DDGS with a carrier form of non-cellulose, free of tobacco. Representative of such non-cellulose carriers are organic carriers such as gum tragacanth, acacia (gum arabic), solka floc, guar gum, dextrin, and the like. Inorganic carriers such as sodium carbonate, calcium carbonate, and the like may also be employed.

A homogeneous blend of the non-cellulose carrier material and the DDGS may be obtained by bringing the two components together and mixing them together employing conventional equipment and mixing techniques. For example, blending may be carried out in a conventional tobacco blending chest.

Advantageously, the blend of non-cellulose carrier and DDGS is wet processed into a dry sheet or web (analogous to a sheet of paper). The method of processing such a blend into a dry sheet is well known and may be that described in the U.S. Pat. Nos. 3,297,039 and 4,542,755 (both of which are incorporated herein by reference thereto). The sheet may be shredded and used as a tobacco substitute in making a "cigarette" free of tobacco. As a preference, the compositions of the invention are processed into a porous rod on a conventional cigarette making machine. The rod may be wrapped with cigarette paper to make a non-burning, simulated cigarette.

The proportion of DDGS homogeneously blended with or added to the non-cellulose carrier to obtain the composition of the invention is a flavor-enhancing proportion. In general a flavor-enhancing proportion will be an amount within the range of from about 0.5 to 95 percent by weight of the non-cellulose carrier.

In addition to DDGS and non-cellulose carrier the compositions of the invention may contain proportions of conventionally known tobacco additives such as conventional flavorants (like menthol, strawberry, apple flavoring), binders, humectants (like propylene glycol, sorbitol and the like), pH modifiers, extenders or fillers, flavor enhancers and the like.

Representative of specific additives which may be employed are:

- Acetophenone
- Alfalfa Extract
- Chamomille Flower Extract
- Vanillin
- Heliotropine
- 2,3,5,6-Tetramethyl pyrazine
- 2,3,5-Trimethyl pyrazine
- Licorice Extract
- Cocoa Extract
- Molasses
- Clary Sage Oil
- St. John's Bread Extract
- Valerian Root Extract
- Oakmoss Absolute
- Nicotine or Nicotine Alkaloids mixtures thereof and the like.

A preferred embodiment composition of the invention includes nicotine as an active ingredient. The nicotine may be provided in the form of a low-volatility compound (such as an acid salt thereof or an ester of nicotine. Advantageously the nicotine is present in the compositions of the invention in a proportion of from 0.1 to 10 percent by weight of the total composition.

Advantageously, the pH of the compositions of the invention is adjusted to be within the range of from about 6.5 to 7.5 to assure that the acidity/alkalinity will not impact on the flavor perceived by the user. Adjustment may be made by the addition of small proportions of pH modifiers such as sodium bicarbonate, citric acid and the like.

The compositions of the invention, in for example a gas porous rod form, may be used as follows. Advantageously the rod element is enclosed in a paper wrapper or like cylinder tube to more closely simulate a conventional cigarette. The enclosed rod may be of a size and configuration to simulate the appearance of a conventional cigarette, and may have attached to one end, a filter element or simulated filter element to further give the impression of a conventional cigarette. The ends of the rod are unobstructed to the passage of gases so that the user may draw air through the rod body from end to end as is accomplished with a conventional cigarette.

Referring now to the accompanying drawing, there is seen a cross-sectional side elevation of an embodiment article 10 of the invention. The article 10 comprises a rod 12 of the composition of the invention, porous to a gas. The rod 12 is covered by a conventional cigarette paper wrapper 14 and has a first end 16 open to the atmosphere. A second end 18 is fitted with a simulated filter tip element 20. In use, the "smoker" engages the element 20 with the lips and draws air into his/her mouth, from end 16 and through the body of rod 12. During passage of the air through the rod 12, flavor and aroma is picked up from the composition of the invention making up the rod 12 and entrained in the air. Volatile nicotine, if present, is similarly entrained, in the air taken into the user's mouth. The entrainment and carriage of the flavors and/or aromatic ingredients does not require combustion of the rod 12, so long as the ingredients to be taken into the user's mouth are sufficiently volatile at room temperature. The active flavorants in the DDGS are of such volatility.

The following examples describe the manner and the process of making and using the invention and set forth the best mode contemplated by the inventor for carrying out the invention.

EXAMPLE

A composition is prepared by blending together the following ingredients:

| | |
|---|---|
| granular DDGS | 80 gm |
| fine grind DDGS | 20 gm |
| solka floc | 5 gm |
| flavor(menthol) | 15 cc |
| water | 85 cc |
| gum tragacanth | 2 gm |
| potassium carbonate | 2.5 gm |
| nicotine | 4 gm |

The blend is extruded into a rod with a packing density of 275 $mg/cm^{-3}$. The rod is cut into 64 mm lengths and covered with a cigarette paper wrapper. The rod is porous to gas, such as air. When air is drawn through the rod, nicotine and the DDGS flavors are volatilized and entrained in the drawn air at ambient (room) temperatures and pressures.

What is claimed is:

1. A tobacco substitute, which comprises;
a non-cellulose compound carrier; and
a flavor-enhancing proportion of distiller's dried grain and solubles;
said substitute being free of tobacco.

2. The substitute of claim 1 which further comprises nicotine.

3. The substitute of claim 1 wherein the non-cellulose compound is an organic compound.

4. The substitute of claim 3 wherein the organic compound is tragacanth gum.

5. The substitute of claim 1 which further comprises an additional flavor agent.

6. An article which comprises a tobacco substitute of claim 1 disposed in a simulated cigarette form.

* * * * *

UNITED STATES PATENT AND TRADEMARK OFFICE

CERTIFICATE OF CORRECTION

PATENT NO. : 4,807,648

DATED : February 28, 1989

INVENTOR(S) : Robert G. Breckwoldt

It is certified that error appears in the above—identified patent and that said Letters Patent is hereby corrected as shown below:

Col. 1, line 1 of Title; delete "cl" at end of line

Col. 1, line 33; insert the following paragraph

-- Although not prior art to me, my issued U.S. Patent 4,693,266 describes the use of distiller's dried grain and solubles in a smoking material to enhance flavor and smoothness of the smoke. --

Signed and Sealed this

Eighth Day of August, 1989

*Attest:*

*Attesting Officer*

DONALD J. QUIGG

*Commissioner of Patents and Trademarks*